US005961373A

United States Patent [19]

Lai et al.

[11] Patent Number: 5,961,373

[45] Date of Patent: Oct. 5, 1999

[54] PROCESS FOR FORMING A SEMICONDUCTOR DEVICE

[75] Inventors: Lei Ping Lai, Austin; Sung C. Kim, Pflugerville, both of Tex.

[73] Assignee: Motorola, Inc., Schaumburg, Ill.

[21] Appl. No.: 08/876,461

[22] Filed: Jun. 16, 1997

[51] Int. Cl.[6] ..... B24B 53/00

[52] U.S. Cl. ..... 451/41; 451/56; 451/443; 451/444; 451/5; 451/21

[58] Field of Search ..... 451/41, 56, 443, 451/444, 285–289, 5, 21

[56] References Cited

U.S. PATENT DOCUMENTS

| | | | |
|---|---|---|---|
| 5,081,051 | 1/1992 | Mattingly et al. | 451/56 |
| 5,216,843 | 6/1993 | Breivogel et al. | 451/56 |
| 5,384,986 | 1/1995 | Hirose et al. . | |
| 5,456,627 | 10/1995 | Jackson et al. | 451/56 |
| 5,486,131 | 1/1996 | Cesna et al. | 451/56 |
| 5,527,424 | 6/1996 | Mullins . | |
| 5,531,635 | 7/1996 | Mogi et al. | 451/56 |
| 5,536,202 | 7/1996 | Appel et al. . | |
| 5,547,417 | 8/1996 | Breivogel et al. . | |
| 5,605,499 | 2/1997 | Sugiyama et al. | 451/443 |
| 5,626,509 | 5/1997 | Hayashi | 451/56 |
| 5,664,987 | 9/1997 | Renteln | 451/56 |
| 5,743,784 | 4/1998 | Birang et al. | 451/56 |
| 5,749,771 | 5/1998 | Isobe | 451/56 |

OTHER PUBLICATIONS

Achuthan, et al., "Investigation of Pad Deformation and Conditioning During the CMP of Silicon Dioxide Films", Journal of Electronic Materials, vol. 25, No. 10 pp. 1628–1632 (1996).

*Primary Examiner*—David A. Scherbel
*Assistant Examiner*—George Nguyen

[57] ABSTRACT

A process for conditioning a polishing pad has been developed that incorporates in-situ conditioning where the conditioning is performed while the substrate (27, 40) is on the polishing pad (22) but terminates before the polishing of the substrate (27, 40) is completed. In one embodiment, ex-situ conditioning of the polishing pad (22) is used on the polishing pad between substrates (27, 40). The process has benefits of both in-situ and ex-situ conditioning.

25 Claims, 3 Drawing Sheets

-PRIOR ART-

PROCESS FOR FORMING A SEMICONDUCTOR DEVICE

FIELD OF THE INVENTION

This invention relates in general to semiconductor device processing and more particularly, to a process for polishing substrates having semiconductor devices.

BACKGROUND OF THE INVENTION

Polishing is being used more in the fabrication of semiconductor devices to achieve higher levels of integration. In polishing, two types of conditioning are typically used. In-situ conditioning conditions the polishing pad as wafers are being polished, and ex-situ conditioning conditions the polishing pads after the wafers have been removed from the pad.

Ex-situ conditioning has been used longer compared to in-situ conditioning but does have some drawbacks. Typically, ex-situ conditioning causes shorter pad life, a lower polishing rate, and worse polishing rate stability. On the other hand, in-situ conditioning has problems with across the die uniformity and particles, contamination, and micro-gouging. Therefore, a need exists for a polishing process in which conditioning of the pad is optimized to give a reproducible polishing process.

BRIEF DESCRIPTION OF THE DRAWINGS

The present invention is illustrated by way of example and not limitation in the accompanying figures, in which like references indicate similar elements, and in which.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiment(s) of the present invention.

DETAILED DESCRIPTION

A process for conditioning a polishing pad has been developed that incorporates in-situ conditioning where the conditioning is performed while the substrate is on the polishing pad but terminates before the polishing of the substrate is completed. In one embodiment, ex-situ conditioning of the polishing pad is used between substrates. The process has benefits of both in-situ and ex-situ conditioning.

Figure 1:
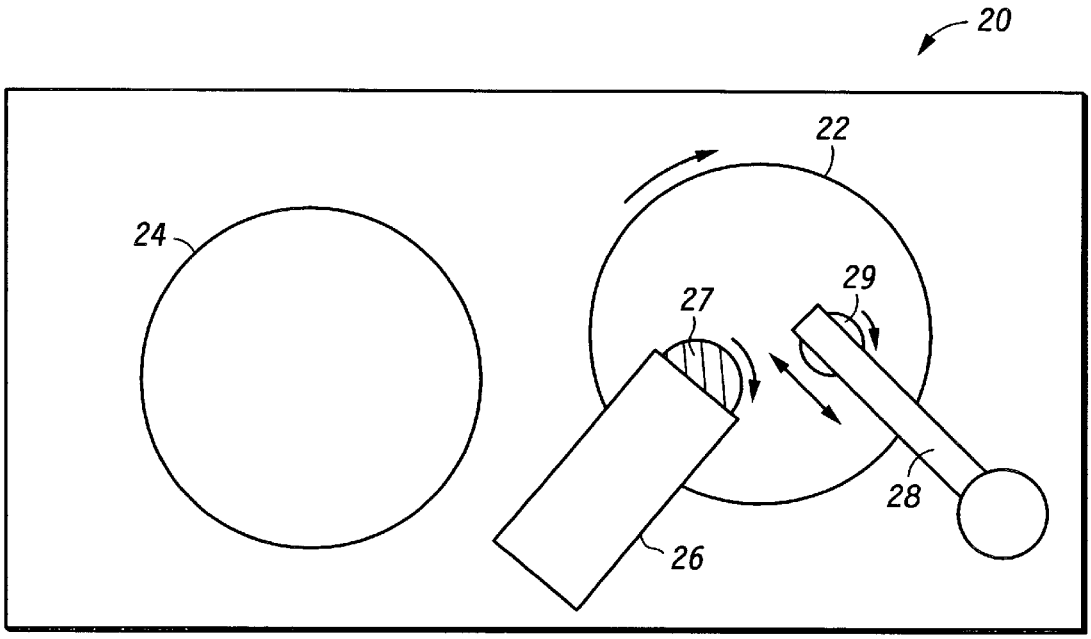
FIG. 1 includes an illustration of a top view of a polishing system (prior art)

FIG. 1 includes an illustration of a top view of a conventional polishing apparatus 20. The polishing apparatus includes a polishing pad 22 and a finishing pad 24. Also shown in FIG. 1 is a polishing arm 26 that holds a semiconductor device substrate 27, and a conditioning arm 28 with a conditioner 29. As used in this specification, a semiconductor device substrate includes a monocrystalline semiconductor wafer, semiconductor-on-insulator wafer, or any other substrate used to form semiconductor devices. In this particular embodiment, the conditioner 29 is a diamond disk that rotates and moves linearly along the conditioning arm 28.

Figure 2:
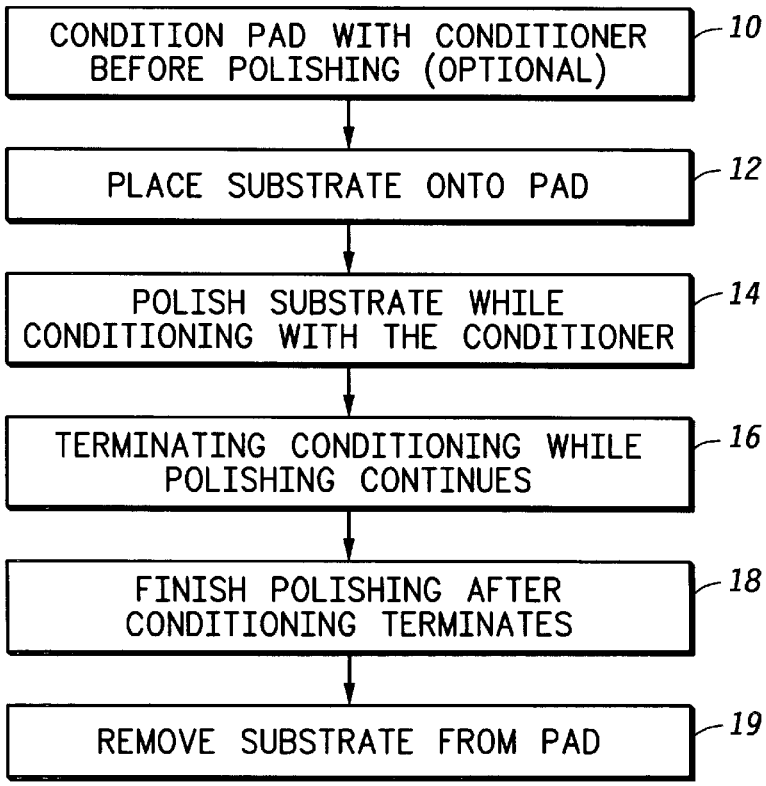
FIG. 2 includes a process flow diagram of a polishing process as used in an embodiment of the present invention.

FIG. 2 includes a process flow diagram in accordance with an embodiment of the present invention. Before polishing the semiconductor device substrate 27, the polishing pad 22 is conditioned with conditioner 29 having a conditioning surface (step 10, which is optional). Next, the semiconductor device substrate 27 is placed onto the pad 22 as shown in step 12. The substrate 27 is polished while the conditioner 29 conditions the pad 22 during a first time period (step 14). While the polishing continues, the conditioning terminates as illustrated in step 16. The polishing finishes after the conditioning has terminated in step 18. In one embodiment of the present invention, the conditioner 29 is removed from the surface of the polishing pad 22 and the conditioning arm 28 is moved away from the polishing pad 22. After all polishing is finished, the substrate 27 is then removed from the polishing pad 22 in step 19 and is transferred over to the finishing pad 24. After the substrate 27 is finished using finishing pad 24, the substrate 27 is then further cleaned and removed from the apparatus 20. Further processing is performed to form a substantially completed device that could include transistors, at least one insulating layer, interconnects, and passivation.

Figure 3:
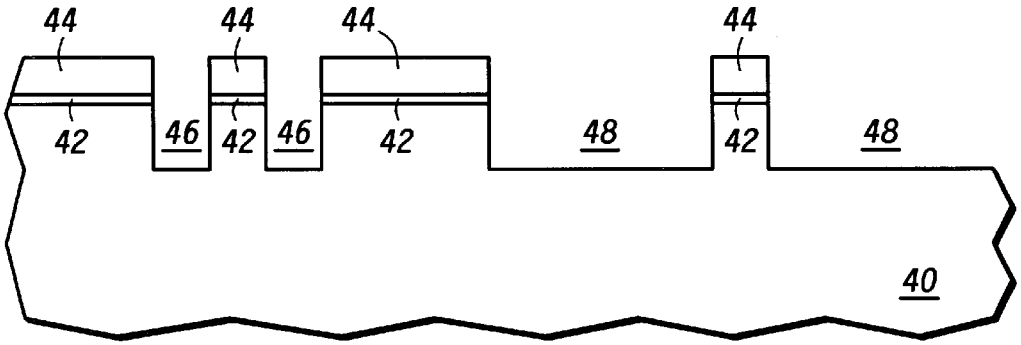
FIG. 3 includes an illustration of a cross-sectional view of a portion of a patterned semiconductor device substrate with a pad layer, a polish-stopping layer, and shallow and wide trenches.

FIGS. 3 through 6 include one embodiment of the present invention used in forming shallow trench isolation having a depth of approximately 0.3 to 0.4 microns. FIG. 3 includes an illustration of a cross-sectional view of a semiconductor device substrate 40. A pad layer 42, usually oxide, nitrided oxide, or the like, is formed over the substrate 40. A polish-stopping layer 44, usually nitride, nitrided oxide, or the like is formed on the pad layer 42. The polish-stopping layer 44 has a lower polishing rate than the oxide. The substrate 40 is patterned such that there are narrow trenches (channels) 46 having a width of less than approximately 1 micron and wide trenches (channels) 48 having a width of greater than approximately 10 microns. Traditionally, this type of pattern has been quite problematic with polishing as the wide trenches 48 are more likely to be dished compared to the narrower trenches 46.

Figure 4:
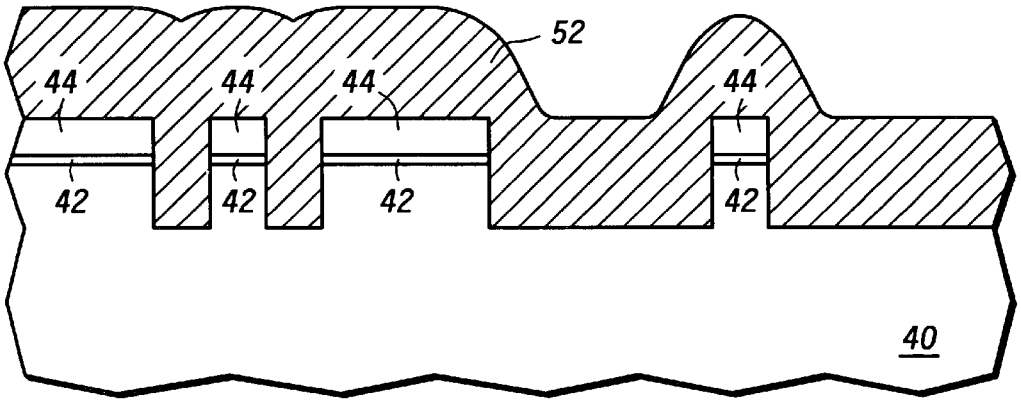
FIG. 4 includes an illustration of a cross-sectional view of the substrate of FIG. 3 with a conformal insulating layer.
Figure 5:
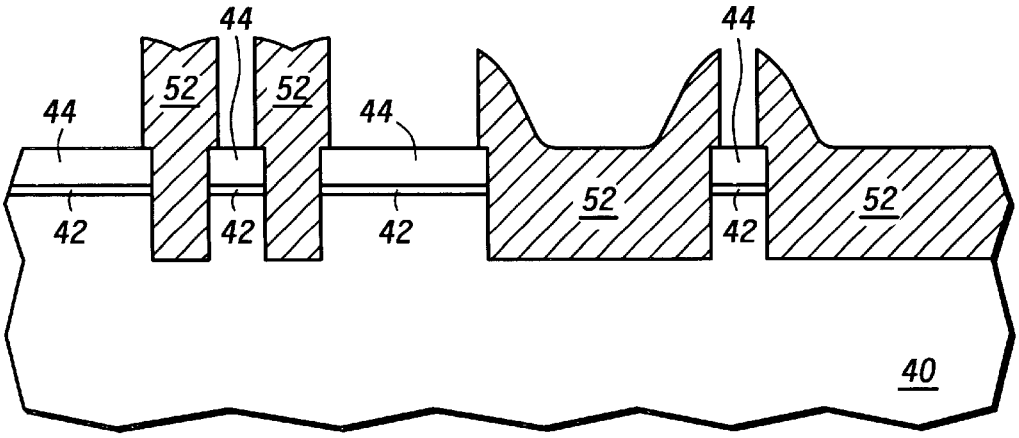
FIG. 5 includes an illustration of a cross-sectional view of the substrate of FIG. 4 where the conformal insulating layer over the polish-stopping layer has been etched.

FIG. 4 includes an illustration of a cross-sectional view of the above semiconductor device substrate 40 after an insulating layer 52 is conformally deposited over the surface including within the trenches 46 and 48. This substantially conformal layer typically includes undoped oxide. As illustrated in FIG. 5, a patterned resist layer (not shown) is then formed over the portions of the insulating layer 52 that overlie the polish-stopping layer 44. The insulating layer 52 is then etched to expose the polish-stopping layer 44 outside of the trenches. Therefore, only a small portion of the insulating layer 52 lies on top of layer 44. The insulating layer 52 has not been etched over the trenches, thus leaving behind "rabbit ears." This step of patterning the insulating layer 52 over layer 44 as illustrated in FIG. 5 is optional but further reduces the likelihood of dishing.

Figure 6:
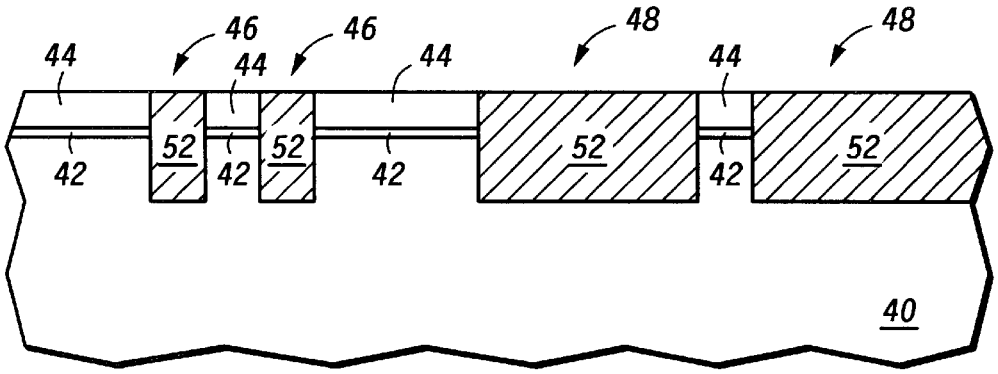
FIG. 6 includes an illustration of a cross-sectional view of the substrate of FIG. 5 after polishing.

FIG. 6 includes an illustration of a cross-sectional view of the patterned semiconductor device where layer 52 has been polished down to the level of the polish-stopping layer 44. Shallow trench isolation has thus been formed. Therefore, the present invention may be used to reduce the effect of dishing in forming wide trench isolation, which has been a problem with previous methods of conditioning the polishing pad using either solely in-situ conditioning during the entire time of polishing the substrate or solely ex-situ conditioning.

In one particular embodiment, the substrate would be polished normally for about 2 minutes and 30 seconds. Traditionally, in-situ conditioning is performed throughout the entire time the substrate 27 is polished. Unlike the prior art, the process of this invention terminates the in-situ conditioning before the end of the polishing step. For example, conditioning of the polishing pad 22 using conditioner 29 begins about one minute before the substrate 27 reaches the pad 22. After that one minute time period has elapsed, the semiconductor device substrate 27 with the insulating layer 52 is then polished while the conditioning proceeds. One minute and 30 seconds later, the conditioning terminates, and the polishing continues for an additional minute. Although the conditioning time and polishing time are approximately the same, the beginning time and ending time of the conditioning are different compared to the prior art. Instead of the two times (conditioning and polishing) being essentially coterminous, the conditioning starts before polishing of the substrate 27, and the conditioning terminates before the end of the polishing step for substrate 27. The time during which both conditioning and polishing occurs will generally be at least as great as the time the polishing continues after the conditioning has stopped. Further, the conditioning time during polishing is typically at most approximately seven times the time that the polishing occurs without any of the conditioning.

Figure 7:
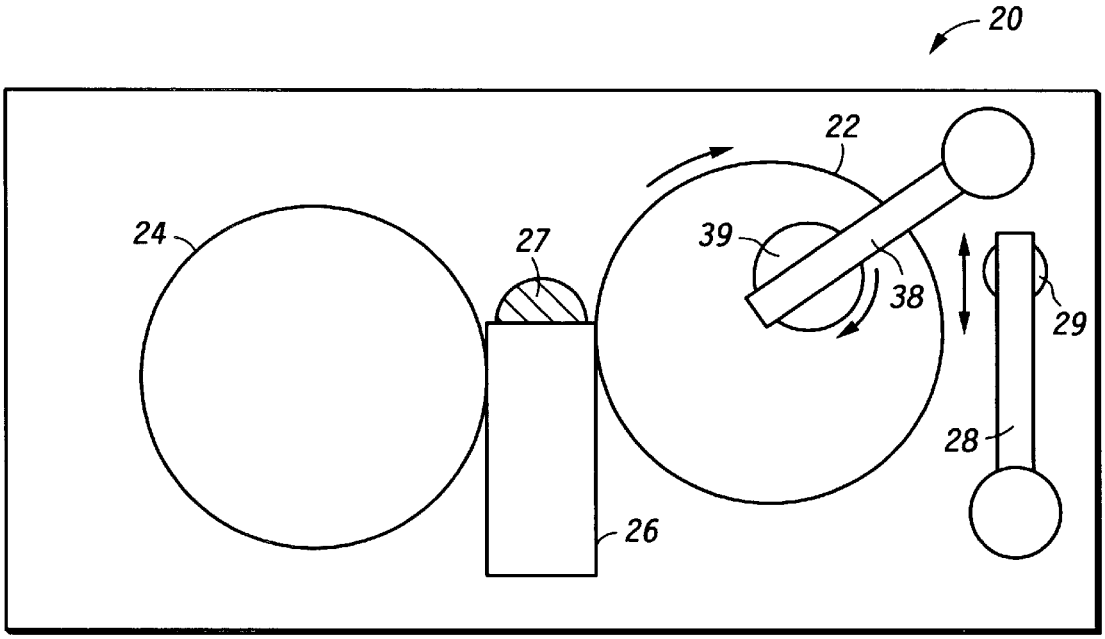
FIG. 7 includes an illustration of a top view of a polishing apparatus in accordance with an alternate embodiment of the present invention.

FIG. 7 includes an illustration of an alternate embodiment of the present invention. As illustrated in FIG. 7, a second conditioning arm 38 and a second conditioner 39 can be used with the present invention. Typically, the second conditioner 39 is more abrasive to the polishing pad 22 compared to conditioner 29. This conditioner may be used ex-situ between substrates being polished on the polishing pad 22. In other words, while semiconductor device substrate 27 is being transferred from the polishing pad 22 to the finishing pad 24, the polishing pad is conditioned using the conditioner 39 until another semiconductor device substrate is placed over the pad 22 for polishing. Before this polishing continues, the second conditioning arm 38 is moved out of the way and the in-situ conditioning arm 28 is then placed over the semiconductor device substrate and polishing continues substantially as described above.

In still another alternate embodiment, the conditioning step 10 as illustrated in FIG. 2 is not necessary. In other words, the conditioning and the polishing can start at the same time, but unlike the prior art, the conditioning terminates before the polishing is completed as illustrated in step 16.

In still another alternate embodiment, the conditioners 29 and 39 may be used at different times during the polishing. More specifically, the more abrasive of the two conditioners 29 and 39 is used during polishing of the semiconductor device substrate 27 during the first portion of polishing. That conditioning arm is then removed and the other conditioner of 29 and 39 is then used to condition polishing pad 22 during the later portion of the polishing process. Still, the time frames described above regarding the first time period and the second time period should still hold true.

In still another alternate embodiment, one conditioner may be used, but the conditioning parameters may be adjusted such that they are less aggressive and do not abrade the polishing pad during the second portion of polishing. In this embodiment, each conditioning parameter includes both a parameter type and a corresponding parameter value for that type. For example, a greater down force pressure, higher rotational speed, or higher linear velocity can be used with conditioner 29 during the first portion of polishing substrate 27. During the later portion, the down force pressure may be lightened, the rotational speed may be reduced, or the linear velocity may be reduced. Of course, other combinations of these parameters may occur such as both a decrease in down force pressure and a reducing of either one or both of the speeds.

The present invention can be used for polishing many different types of films. For example, it can be used for polishing insulating layers, metal-containing layers, or a number of other different layers. Usually, the layer will include a first film and a second film that overlies the first film. The first film is typically polished at a slower rate than the second film using the same polishing conditions. In many of these instances, the second film is a layer being polished and the first layer is a polish stopping layer. With interconnects (either between metals or between poly and metal), it is common for the insulating layer to include two different films: a faster polishing doped oxide, such as borophosphosilicate glass (BPSG), phosphosilicate glass (PSG), or the like, over a slower polishing undoped or more lightly doped oxide.

Embodiments of the present invention have many benefits. More specifically, the present invention can be used for polishing substrates having fairly significant topological changes over the surface. One type of device that has problems related to topology is a microprocessor or any other device that incorporates both logic and memory on one chip. In these chips, there will be two distinct types of regions. One will include the cache memory region (which may also include peripheral logic circuitry used to operate a memory array within the cache memory region). A different region includes the logic region (outside the cache memory region) that has a central processing unit or other circuitry used to process data from the cache memory region. The memory may be static random access memory, dynamic random access memory, floating gate memory, or nearly any other type of memory. The uppermost surface of the interlevel dielectric layer being deposited (typically having a thickness of at least approximately 4,000 Angstroms) over bit lines in the cache memory region and interconnects in the logic region will lie at essentially two different elevations. Over the cache memory region, the uppermost surface will lie at a higher elevation than the uppermost surface over the logic region. These elevational differences cause problems in polishing the semiconductor devices, particularly within each die. The cache memory and logic regions each typically occupy at least 10% of the total substrate area for that die. The layer being formed needs to be polished to achieve a substantially planar surface.

By using the process of the present invention, one can achieve the benefits of the in-situ conditioning that includes a longer pad life, faster polishing rate, and more rate stability compared to ex-situ conditioning, but also achieve the benefits of ex-situ conditioning that generally has better uniformity and also less particulate and contamination-related problems compared to in-situ conditioning. The polishing rate during the in-situ portion of the polishing process is relatively stable until the conditioning terminates. After the conditioning terminates, the polishing rate decreases exponentially. However, the polishing process becomes more mechanical after the pad has been glazed over by the oxide polishing product. This glazing causes more of the uppermost surface to be removed mechanically, which attacks the insulating layer faster over the cache memory region compared to the logic region and helps planarize the substrate. The process also helps in reducing the amount of dishing of the insulating layer over the logic region and also helps prevent potentially eroding too much of the insulating layer away from over the outermost bit-lines within a memory array.

An embodiment of the present invention has been described in use with an insulating layer, but it may also be used with conductive layers. Typically, a film is used for a barrier or adhesion layer, such as titanium nitride, tantalum nitride, or the like, and is subsequently covered by a layer of a conductive material, such as tungsten, aluminum, copper, or the like. Typically, the lower film polishes at a lower rate compared to the upper film. Embodiments of the present invention provides good process stability when polishing the softer metals over the underlying harder refractory metal nitrides that underlie those layers.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. In the claims, means-plus-function clause(s), if any, cover the structures described herein that perform the recited function(s). The mean-plus-function clause(s) also cover structural equivalents and equivalent structures that perform the recited function(s).

We claim:

1. A process for forming a semiconductor device comprising the steps of:

placing a substrate onto a polishing pad within an apparatus, wherein a layer overlies the substrate;

polishing the layer and conditioning the polishing pad using a first conditioner during a first time period;

polishing the layer without conditioning the polishing pad using the first conditioner for a second time period after the first time period and before depositing an additional layer; and removing the substrate from the apparatus after the steps of polishing.

2. A process as in claim 1, wherein the substrate is a patterned semiconductor device substrate.

3. A process as in claim 1, wherein the layer includes an insulating layer.

4. A process as in claim 1, wherein the layer comprises a first film and a second film that overlies the first film, and wherein the first film has a slower polishing rate compared to the second film.

5. A process as in claim 1, wherein the first time period is at least approximately equal to the second time period.

6. A process as in claim 5, wherein the first time period is at most approximately seven times the second time period.

7. A process as in claim 1, wherein the first time period is at most approximately seven times the second time period.

8. A process as in claim 1, wherein the step of polishing the layer without conditioning the polishing pad using the first conditioner for a second time period after the first time period, further comprises a step of conditioning the polishing pad using a second conditioner that is different from the first conditioner, wherein this step is performed after the step of removing the substrate.

9. A process as in claim 8, further comprising the step of conditioning the polishing pad using the second conditioner, wherein this step is performed before the step of placing the substrate.

10. A process as in claim 1, wherein the layer comprises a conductive, metal-containing material.

11. A process as in claim 1, wherein the step of polishing the layer without conditioning the polishing pad using the first conditioner for a second time period after the first time period, further comprises a step of polishing the layer and conditioning the polishing pad using a second conditioner during the second time period, wherein the first conditioner has a conditioning surface that is rougher than a conditioning surface of the second conditioner.

12. A process for forming a semiconductor device comprising the steps of:

conditioning a polishing pad using a first conditioner;

placing a substrate onto a polishing pad within an apparatus, wherein a layer overlies the substrate after the step of conditioning;

polishing the layer and conditioning the polishing pad using a second conditioner during a first time period;

polishing the layer without conditioning the polishing pad for a second time period after the first time period and before depositing an additional layer; and removing the substrate from the apparatus after the steps of polishing.

13. A process as in claim 12, wherein the substrate is a patterned semiconductor device substrate.

14. A process as in claim 13, wherein the patterned semiconductor device substrate has a first channel that is at least approximately 10 microns wide and a second channel that is at most approximately 1 micron wide.

15. A process as in claim 14, further comprising the step of patterning the substrate before the step of polishing the layer and conditioning the polishing pad using the second conditioner during the first time period.

16. A process as in claim 15, wherein the patterned semiconductor device substrate has a first region and a second region adjacent to the first region within a substrate area, wherein each of the first and second regions occupy at least approximately 10 percent of the substrate area, and an uppermost surface of the layer overlying the first region lies at an elevation higher than the uppermost surface of the layer overlying the second region.

17. A process as in claim 16, wherein the first region includes a cache memory region and the second region includes a logic region.

18. A process as in claim 17, wherein the layer is at most approximately 4000 Å thick and the layer is an interlevel dielectric layer.

19. A process as in claim 12, wherein the first time period is at least approximately equal to the second time period.

20. A process as in claim 12, wherein the first time period is at most approximately seven times the second time period.

21. A process for forming a semiconductor device comprising the steps of:

placing a substrate onto a polishing pad within an apparatus, wherein a layer overlies the substrate;

polishing the layer and conditioning the polishing pad using a first conditioner during a first time period, wherein the conditioning is performed using a first conditioning parameter having a first type and a first value;

polishing the layer and conditioning the polishing pad using the first conditioner during a second time period after the first time period, wherein;

the conditioning is performed using a second conditioning parameter having a second type and second value that is different from the first value; and the substrate remains on the polishing pad between the first time period and the second time period; and removing the substrate from the apparatus after the steps of polishing.

22. A process as in claim 21, wherein the first type of the first conditioning parameter is of a same type as the second type of the second conditioning parameter and is a type selected from a group consisting of down force pressure, rotational speed, and linear velocity.

23. A process as in claim 22, wherein the second value of the second conditioning parameter is less than the first value of the first conditioning parameter.

24. A process as in claim 21, wherein the first time period is at least approximately equal to the second time period.

25. A process as in claim 21, wherein the first time period is at most approximately seven times the second time period.

* * * * *